United States Patent [19]

Binder et al.

[11] Patent Number: 4,707,888

[45] Date of Patent: Nov. 24, 1987

[54] METHOD AND ARRANGEMENT FOR EXTRACTING FIBER FLOCKS FROM TEXTILE FIBER BALES

[75] Inventors: Rolf Binder, Schottikon; Walter Schlepfer, Winterthur, both of Switzerland

[73] Assignee: Maschinenfabrik Rieter AG, Winterthur, Switzerland

[21] Appl. No.: 838,554

[22] Filed: Mar. 11, 1986

[30] Foreign Application Priority Data

Mar. 22, 1985 [CH] Switzerland ..... 01271/85

[51] Int. Cl.[4] ..... D01G 13/00; D01G 7/06

[52] U.S. Cl. ..... 19/80 R; 19/81

[58] Field of Search ..... 19/80 R, 81

[56] References Cited

U.S. PATENT DOCUMENTS

| | | | |
|---|---|---|---|
| 3,170,196 | 2/1965 | Denis | 19/80 R |
| 4,281,437 | 8/1981 | Marx | 19/80 R |
| 4,297,767 | 11/1981 | Leifeld | 19/80 R |
| 4,357,737 | 11/1982 | Marx | 19/80 R |
| 4,477,944 | 10/1984 | Binder et al. | 19/80 R |
| 4,510,646 | 4/1985 | Locatelli et al. | 19/80 R |
| 4,513,479 | 4/1985 | Binder et al. | 19/80 R |
| 4,586,217 | 5/1986 | Kranefeld et al. | 19/80 R |

*Primary Examiner*—Louis K. Rimrodt

*Attorney, Agent, or Firm*—Michael J. Striker

[57] ABSTRACT

An arrangement for extracting fiber flocks from textile fiber bales includes a fiber flock extraction member which passes between and projects to a predetermined extent beyond respective grid bars which rest on the bale surface during the extraction operation, for the extraction member to extract the fiber flocks from the surface layer of the bale. The extent to which the extraction member extends beyond the grid bars can be adjusted in dependence on the fiber type. To achieve this, the grid bars are movable with respect to the extraction member by respective screw-threaded spindles. This adjustment is performed under the control of a suitable control system, especially a microprocessor, such that the extent of projection of the extraction member beyond the grid bars is automatically accommodated to the fiber type of each bale or bale group from which the fiber flocks are to be extracted during a particular extraction operation.

5 Claims, 3 Drawing Figures

N
Ha
Hb
Hc
Hd
A
B
C
D

METHOD AND ARRANGEMENT FOR EXTRACTING FIBER FLOCKS FROM TEXTILE FIBER BALES

BACKGROUND OF THE INVENTION

The present invention relates to the extraction of fiber flocks from textile bales in general, and more particularly to a method and an arrangement for accomplishing such extraction in a controlled manner in dependence on the characteristic properties of the bales and their material.

There is already known a bale opening machine which is distributed under the trademark UNIFLOC by the assignee of the present invention and in which a flock extraction device is mounted on a carrier which is movable back and forth along the bales. This known arrangement renders it possible to extract fiber flocks from bales having different dimensions and particularly heights and/or containing different fiber materials. The extraction device of this known arrangement includes a fiber extraction member which passes between grid bars and projects to a predetermined extent beyond such grid bars.

During the use of this arrangement for fiber flock extraction, the grid bars also penetrate into the surface layer of the respective bale, but the depth of such penetration of the grid bars into the surface layer of the bale is less than that of the extraction member by the aforementioned predetermined extent. The penetration of the extraction member into the surface layer of the bale is often referred to as the extraction or penetration depth and it can vary in dependence on the extraction power.

German published patent application DE-OS No. 32,45,506 discloses a device in which the extraction member can penetrate with a variable force into the bale surface layer in dependence on the density of the bale layer to be opened.

Variation of the fiber type, and the extraction conditions which result therefrom, were not taken into consideration in the known methods and arrangements which have been mentioned above.

SUMMARY OF THE INVENTION

Accordingly, it is a general object of the present invention to avoid the disadvantages of the prior art.

More particularly, it is an object of the present invention to provide a method of extracting fiber flocks from textile bales, which does not possess the disadvantages of the known methods of this kind.

Still another object of the present invention is so to devise the method of the type here under consideration as to render it possible to easily accommodate the arrangement employing this method to varying operating conditions.

It is yet another object of the present invention to develop an arrangement which is especially suited for the performance of the above method.

A concomitant object of the present invention is so to construct the arrangement of the above type as to be relatively simple in construction, inexpensive to manufacture, easy to use, and reliable in operation nevertheless.

In pursuance of these objects and others which will become apparent hereafter, one feature of the present invention resides in a method of extracting fiber flocks from textile fiber bales by an extraction member which extends between and beyond grid bars and penetrates into the surface layer of the respective fiber bale to extract the fiber flocks therefrom for transfer to a flock transport system, such method comprising the step of varying the extent to which the extraction member extends beyond the grid bars in dependence on at least one of the density and the type of the fiber material of the surface layer.

According to another aspect of the present invention, this method can be used in an application in which the extraction member moves in a plurality of passes over the respective fiber bale and extracts the fiber flocks from the surface layer thereof to a predetermined penetration depth during each pass. Then, the method further comprises the step of changing the penetration depths for different passes independently of the varying step in dependence on at least one of the bale height, the density, and the type of the fiber material of the surface layer.

It is also advantageous when the method of the present invention is used in an application in which the extraction member extracts the fiber flocks from a plurality of textile bales of different bale heights and/or fiber types. In this case, the varying step includes adjusting the extent of penetration of the extraction member from one bale of the plurality to another in dependence upon at least one of the height and the fiber type of the particular bale.

According to another concept of the present invention, there is provided an arrangement for extracting fiber flocks from fiber bales, such arrangement comprising an extraction device including a plurality of grid bars which penetrate during an extraction operation into a surface layer of the respective bale; an extraction member which extends between and beyond the grid bars to penetrate into the surface layer of the respective fiber bale to an extent exceeding the penetration of the grid bars into the surface layer to extract the fiber flocks from the surface layer; and means for varying the extent to which the extraction member extends beyond the grid bars in dependence on the requirements of the particular extraction operation.

An advantageous construction of the above arrangement is obtained when such arrangement further comprises a reciprocating device operative for moving the extraction device down and up relative to the bales to cause the extraction member to penetrate into the surface layer of the respective bale to a predetermined penetration depth and move away from the bale, respectively; and programmable controlling means for controlling the operation of at least one of the reciprocating device, the grid bars and the extraction member for adjusting the aforementioned extent in dependence on at least one of the fiber type and the penetration depth.

Last but not least, it is advantageous when the reciprocating device includes a pulse generator operative for issuing signals representative of the up and down movement of the extraction device, when there are provided respective switch elements operative for issuing respective position signals when the extraction device reaches its upper and lower end positions, respectively, and a sensor element mounted on the extraction device and operative for issuing an additional signal when the extraction device has reached the bale surface during its downward movement, and when the programmable controlling means includes a microprocessor operative for controlling the adjustment of the extent of penetration of the extraction member on the basis of the above-mentioned signals and in dependence on at least one of a predetermined penetration depth and fiber type of the particular bale.

The novel features which are considered as characteristic of the invention are set forth in particular in the appended claims. The improved fiber flock extraction arrangement itself, however, both as to its construction and its mode of operation, together with additional features and advantages thereof, will be best understood upon perusal of the following detailed description of certain specific embodiments with reference to the accompanying drawing.

DETAILED DESCRIPTION OF THE PREFERRED EMBODIMENTS

Figure 1:
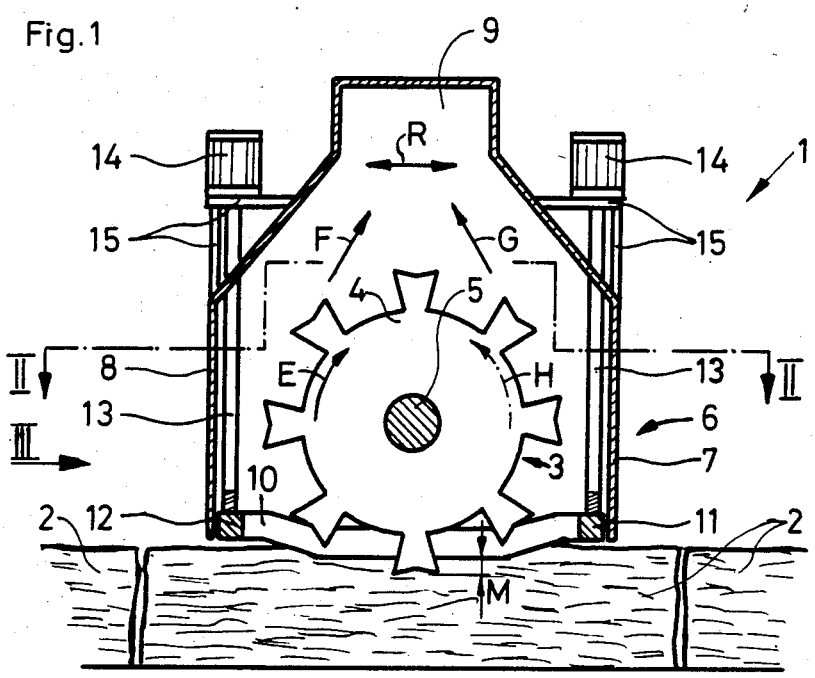
FIG. 1 is a somewhat simplified cross-sectional view of a flock extraction device embodying the present invention, taken on line I—I of FIG. 2.

Referring now to the drawing in detail, and first to FIG. 1 thereof, it may be seen that the reference numeral 1 has been used therein to identify an apparatus for extracting fiber flocks (not shown) from fiber bales 2. The apparatus 1 comprises a fiber extraction member 3 which includes a rotatable shaft 5 having toothed discs 4 mounted thereon.

A housing 6 of the apparatus 1 includes housing walls 7 and 8 that enclose the fiber extraction member 3 in such a manner that fiber flocks (not shown) which are extracted by the teeth of the toothed discs 4 from the fiber bales 2 can be forwarded into a pneumatic flock transport duct 9 formed by an upper portion of the housing 6. The extracted flocks are forwarded in the direction of an arrow F when the extraction member 3 rotates in the direction of an arrow E, while the forwarding of the extracted flocks occurs in the direction of an arrow G when the extraction member 3 rotates in the direction of an arrow H.

In order to enable flock extraction, the toothed discs 4 pass between grid bars 10 and project by a predetermined distance M beyond these grid bars 10. The grid bars 10 also penetrate into the surface layer of the fiber bales 2 but by an amount which is less by the distance M than the extent of penetration of the discs 4 into the bales 2.

Figure 2:
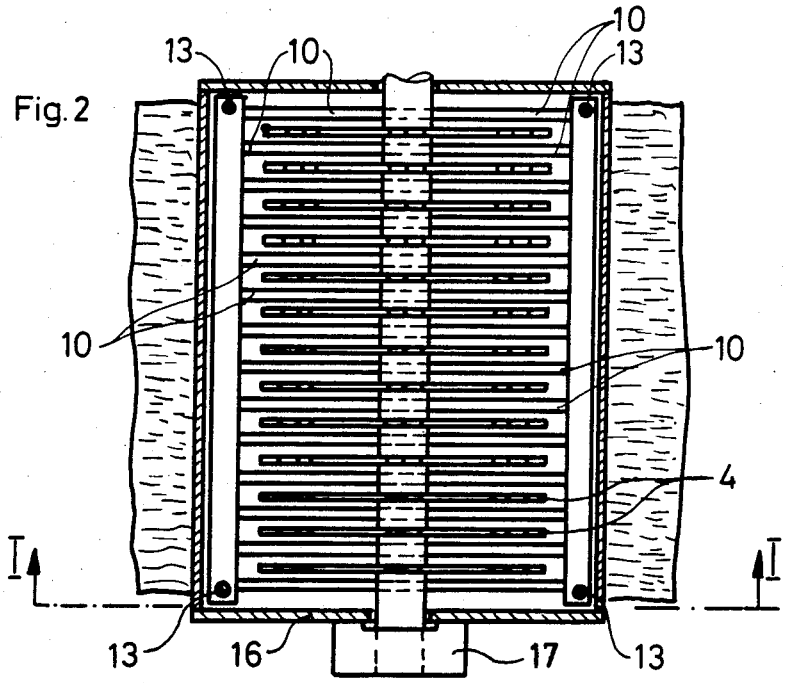
FIG. 2 is a sectional view of the flock extraction arrangement taken on line II—II of FIG. 1.

In order to enable variation of the distance M, the grid bars 10 are secured to longitudinal supports 11 and 12 which can be moved up or down by means of screw-threaded spindles 13. In turn, the spindles 13 are constituted by extended shafts of gear stop motors 14, which are supported by means of brackets 15 on the walls 7 and 8, respectively. As seen in FIG. 2 of the drawing, there are provided two screw-threaded spindles 13 for each longitudinal support 11 and 12.

In operation, all motors 14 must be operated simultaneously in order to raise or lower the grid bars 10. For safety, and in order to ensure the requisite precision of movement of the grid bars 10, the number of revolutions of the rotatable part of each of the motors 14 is controlled and correspondingly synchronized.

A simpler, non-illustrated embodiment comprises only one gear stop motor and transmission from this motor to the other three spindles 13 is effected, for example, by a conventional type of chain transmission.

The shaft 5 of the extraction member 3 is rotatably supported at one of its ends in a bearing 17 secured in one end wall 16 of the housing 6, and is connected at its other end to a drive (not shown). It may be seen in FIG. 2 that a grid bar 10 is present on each side of each of the toothed discs 4. In principle, there is also the possibility of making the extraction member 3 adjustable instead of the grid bars 10; for example, the bearings receiving the shaft 5 could be adjustably arranged. It is also conceivable that the grid bars 10 and the extraction member 3 could be so constructed and mounted as to be mutually adjustable.

In operation, as indicated in FIG. 1, the extraction apparatus 1 is moved back and forth over the fiber bales 2 in the directions identified by a double-headed arrow R.

Figure 3:
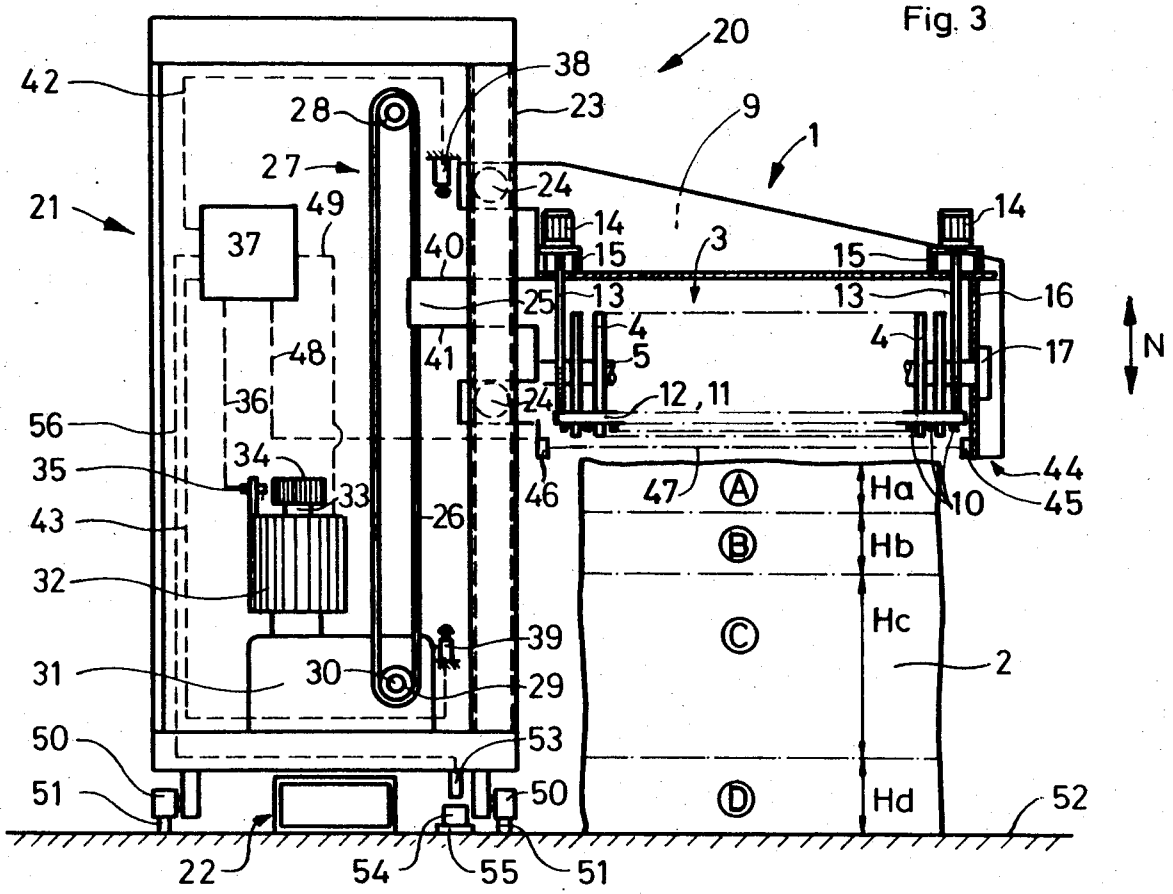
FIG. 3 is a side elevational view of a machine incorporating the flock extraction arrangement of FIGS. 1 and 2, taken in the direction of the arrow III in FIG. 1.

FIG. 3 of the drawing illustrates a machine 20 for extracting fiber flocks from bales 2, this machine 20 comprising the extraction apparatus 1. In addition to the extraction apparatus 1, the machine 20 comprises a machine frame 21 and a flock transport system 22. The transport path and transport devices situated between the flock forwarding duct 9 and the flock transport system 22 are not illustrated since they are well known and are not the subject of this invention.

The extraction apparatus 1 is movable up and down in the direction of a double-headed arrow N by means of rollers 24 rotatably mounted on the extraction apparatus 1 and guided on guide rails 23 of the machine frame 21. However, only one roller pair 24 and only one rail 23 are illustrated in FIG. 3; rollers 24 and rail 23 which are similarly arranged on the opposite side are not visible in FIG. 3.

Furthermore, the extraction apparatus 1 comprises a projection 25 which is fixedly secured to a chain 26 of a chain transmission 27. The chain transmission 27 further comprises an upper, rotatably supported chain sprocket 28 for guiding the chain 26, and a lower chain sprocket 29 for driving this chain 26. The lower chain wheel 29 is fixedly secured to a drive shaft 30 of a gear transmission 31 for joint rotation therewith. An electric motor 32 is connected to the gear transmission 31 and serves as a source of energy therefor, this motor 31 also being constructed as a stop motor. The machine frame 21, the guide rails 23, the chain transmission 27, the gear transmission 31 and the electric motor 32 will be collectively referred to herein as a reciprocating apparatus.

At its upper end, as viewed in the FIG. 3 of the drawing, the shaft 33 of the motor 32 carries a toothed wheel 34 rotatable with the shaft 33. The wheel 34 functions as a counter wheel cooperating with a magnetic sensor 35 in such a manner that the sensor 35 constitutes a pulse generator. The output pulses from the pulse generator 35 are fed via a lead 36 to a microprocessor 37. The sensor 35 is of a commercially available type and emits a pulse each time it is passed by a tooth of the toothed wheel 34. The sensor 35 is stationary.

An upper end switch 38 and a lower end switch 39 are provided on the machine frame 21 and are operative for sensing the upper and lower end positions of the extraction apparatus 1, respectively. The upper end switch 38 is operated by an upper surface 40 of the projection 25 and the lower end switch 39 is operated by a lower surface 41 of the projection 25. The upper end switch 38 supplies an output pulse to the microprocessor 37 via a lead 42 and the lower end switch 39 supplies its output pulse to the microprocessor via a lead 43.

The extraction apparatus 1 is further provided, on its lower side 44 facing the fiber bales 2, with a light barrier including a light generator 45 and an optical receiver 46. The light barrier 45 and 46 is so arranged that the light generator 46 generates a light beam 47 extending at least over the entire length of the fiber extraction member 3; the light beam 47 is transformed in the optical receiver 46 into an electrical signal supplied via a lead 48 to the microprocessor 37. A further lead 49 connects the electric motor 32 with the microprocessor 37.

Finally, the machine frame 21 is arranged for movement (not indicated in the drawing) along the fiber bales 2 and above the flock transport system 22. This movement is enabled by wheels 50 drivably mounted on the machine frame 21 and running on rails 51 which are secured to the floor 52 of the spinning mill.

In operation, the fiber bales 2 are laid out in a known manner in groups (not shown), namely so that bales 2 of substantially the same height are arranged together in a respective bale group and a spacing of 1.2–1.5 meters is maintained between the individual bale groups. For locating the machine frame 21 in its end positions and in its positions between the individual bale groups, a sensor 53 is provided on the underside of the machine frame 21 and so-called positioning elements 54 are provided over the entire length along which the machine 20 can travel; the positioning elements 54 are movably arranged on one rail 55. The presence of these positioning elements 54 is sensed by the sensor 53 and indicated via a lead 56 to the microprocessor 37.

The previously mentioned end positions comprise, on the one hand, a starting position of the machine 20 at the beginning of the rails 50, from which starting position the movement of the machine 20 commences, and on the other hand, a final position at which the machine 20 changes its direction of travel. The distribution of the positioning elements 54 is effected in such a manner that the machine 20 with the extraction member 3 is halted ahead of the first bale group, or behind the last bale group, or between the individual bale groups.

In order to extract the fiber flocks from the bales 2 with a variable penetration depth corresponding to the density of the fiber material of the bales 2, but with a substantially constant extraction power, the bale height is divided into three or four zones. In the example presented here, there are four such zones indicated at A, B, C and D. The extraction procedure begins in the following manner:

Prior to the first extraction step, the extraction member 3 travels over the path from the upper end switch 38 to the lower end switch 39. In the course of this movement, the microprocessor 37 counts the number of pulses generated by the magnetic sensor 35 in response to the pass of the teeth of the toothed wheel 34 past the magnetic sensor 35 and registers thereby the sum of all these pulses, this sum being representative of the spacing between the lower and upper end positions.

Thereafter, the microprocessor 37 is programmed for flock extraction in the following manner:

First of all, two items of data are entered into the microprocessor 37, namely the predetermined penetration depth per pass of the extraction member 3 over the bale groups for the zone A, and the number of passes which are to be carried out with this penetration depth; this gives a height Ha. Then, the number of passes for the zone B is entered. The penetration depth for the zone B is calculated by the microprocessor 37. This penetration depth is reduced in a stepwise manner during the entered number of passes, namely from the penetration depth of the zone A to the penetration depth of the zone C. The height Hb is derived from the calculation by the microprocessor 37. Thereafter, the penetration depth for the zone C is entered.

As a modification, instead of entering the penetration depth per pass for the zone C, the weight of the complete bale layout and the required production rate per hour can be entered. From this data, together with the bale height, the microprocessor 37 calculates the penetration depth for all bale groups in such a manner that flock extraction is completed for all bale groups simultaneously.

Further, the penetration depth for the last pass, and the number of passes for the zone D, are entered. During these passes, the penetration depth is increased stepwise from the penetration depth for the zone C to that of the final pass. From this data, the microprocessor 37 calculates the height Hd of the zone D and thus the start of the penetration depth which is increased again in this zone D. The height Hc of the zone C is derived from the total height minus the heights Ha, Hb and Hd.

Finally, the distance M is programmed into the microprocessor 37 in dependence upon the fiber material of the individual bale groups or bales 2, so that, when corresponding signals are obtained from the corresponding positioning element 54, the distance M is adapted to the fiber material of the bale groups or bales 2 to be processed.

After the above-mentioned programming steps, the machine 20 is put into its flock extraction mode by an attendant who presses a start button (not shown) at this time.

Upon operation of the upper end switch 38, the machine 20 travels, with the extraction apparatus 1 in the upper end position, from its starting position on the rails 51 over the bales 2 laid out on the floor 52. After passing over the first positioning element 54, which is indicated by the sensor 53, the machine 20 continues to travel for several seconds so that the extraction apparatus 1 is located above the bale group. Thereafter, the extraction apparatus 1 is lowered in response to a control command of the microprocessor 37 supplied to the motor 32 via the lead 49. The lowering of the extraction apparatus 1 continues until the light beam 47 is interrupted by the bales 3. Due to this lowering until the interruption of the light beam 47, the pulses generated by the magnetic sensor 35 in response to the movement of the toothed wheel 34 are continually subtracted in the microprocessor 37 from the previously obtained total pulse sum, so that, when the extraction apparatus 1 comes to a stop as a result of the interruption of the light beam 47, the height of this bale group is determined.

If additional bale groups are present, the machine 20 automatically travels further until the next positioning element 54 is detected. The machine 20 is then stopped in a similar manner and the extraction apparatus 1 again travels into the upper end position. After the machine 20 has travelled so far past the lastmentioned positioning element 54 that the extraction apparatus 1 is again located over the next bale group, the height of this bale group is again determined in the previously mentioned manner. The same operation is carried out for all further bale groups.

After the determination of all bale group heights, the extraction apparatus is lowered before each pass over a bale group for extraction of fiber flocks from the bale surfaces by a penetration depth amount entered into or calculated by the microprocessor 37. These penetration depths can be different for each bale group in dependence upon the respective bale height. Switching of the penetration depths for flock extraction from one bale group to the penetration depth for the next bale group, and the adjustment of the distance M, is carried out automatically by the microprocessor 37. The penetration depths and number of the passes, and thus the zone heights, can be adapted at any time without interruption of the extraction procedure. The same applies to the adjustment of the distance M.

The flock transport system 22 can comprise a pneumatic transport duct (FIG. 3) or a transport conveyor (not shown) or any other transport means suitable for fiber flocks. Finally, the reciprocating apparatus can consist of other elements suitable for raising and lowering the extraction apparatus 1; it is not limited to the illustrated elements.

It will be understood that each of the elements described above, or two or more together, may also find a useful application in other types of arrangements differing from the type described above.

While the invention has been illustrated and described as embodied in an arrangement for extracting fiber flocks from bales of different heights, it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic and specific aspects of our contribution to the art and, therefore, such adaptations should and are intended to be comprehended within the meaning and range of equivalence of the claims.

What is claimed as new and desired to be protected by Letters Patent is set forth in the appended claims.

We claim:

1. A method of extracting fiber flocks from textile fiber bales by an extraction member which extends between and beyond grid bars and penetrates into the surface layer of the respective fiber bale to extract the fiber flocks therefrom for transfer to a flock transport system, comprising the steps of varying the extent to which the extraction member extends beyond the grid bars in dependence on the density and/or the type of the fiber material of the surface layer; moving the extraction member in a plurality of passes over the respective fiber bale and extracting the fiber flocks from the surface layer thereof with a variable penetration depth during each pass dependent upon the bale height, wherein said penetration depths for different passes and said varying the extent to which the extraction member extends beyond the grid bars, are automatically variable, independently of each other in dependence on the density and/or the type of the fiber material of the surface layer.

2. The method as defined in claim 1 for use in an application in which the extraction member extracts the fiber flocks from a plurality of textile bales of different bale heights and/or fiber types, wherein said varying step includes adjusting said extent from one bale of the plurality to another in dependence upon at least one of the height for the fiber type of the particular bale.

3. An arrangement for extracting fiber flocks from fiber bales, comprising an extraction device including a plurality of grid bars which penetrate during an extraction operation into a surface layer of the respective bale; an extraction member which extends between and beyond said grid bars to penetrate into the surface layer of the respective fiber bale to an extent exceeding the penetration of said grid bars into the surface layer to extract the fiber flocks from the surface layer; means for automatically varing the extent to which the extraction member extends beyond said grid bars in dependence on the requirements of the particular extraction operation; and a reciprocating device operative for moving said extraction device back and forth along the bales as well as down and up relative to the bales to cause the extraction member to penetrate into the surface layer of the respective bale to a predetermined penetration depth and move away from the bale, respectively; and programmable controlling means for controlling the operation of at least said reciprocating device, said grid bars or said extraction member for adjusting said extent in dependence on the fiber type and/or the penetration depth.

4. An arrangement for extracting fiber flocks from fiber bales, comprising an extraction device including a plurality of grid bars which penetrate during an extraction operation into a surface layer of the respective bale; an extraction member which extends between and beyond said grid bars to penetrate into the surface layer of the respective fiber bale to an extent exceeding the penetration of said grid bars into the surface layer to extract the fiber flocks from the surface layer; means for varying the extent to which the extraction member extends beyond said grid bars in dependence on the density and/or the type of the fiber material of the surface layer; means for moving the extraction member in a plurality of passes over the respective fiber bale and extracting the fiber flocks from the surface layer thereof with a variable penetration depth during each pass dependent upon the bale height; and means for changing the penetration depth for different passes independently on the varying means and in dependence on the density and the type of the fiber material of the surface layer.

5. An arrangement for extracting fiber flocks from fiber bales, comprising an extraction device including a plurality of grid bars which penetrate during an extraction operation into a surface layer of the respective bale; an extraction member which extends between and beyond said grid bars to penetrate into the surface layer of the respective fiber bale to an extent exceeding the penetration of said grid bars into the surface layer to extract the fiber flocks from the surface layer; means for varying the extent to which the extraction member extends beyond said grid bars in dependence on the requirements of the particular extraction operation; a reciprocating device operative for moving said extraction device down and up relative to the bales to cause the extraction member to penetrate into the surface layer of the respective bale to a predetermined penetration depth and move away from the bale, respectively, said reciprocating device including a pulse generator operative for issuing signals representative of the up and down movement of said extraction device; programmable controlling means for controlling the operation of at least one of said reciprocating device, said grid bars and said extraction member for adjusting said extent in dependence on at least one of the fiber type and the penetration depth; and respective switch elements operative for issuing respective position signals when said extraction device reaches its upper and lower end positions, respectively, and a sensor element mounted on said extraction device and operative for issuing an additional signal when said extraction device has reached the bale surface during its downward movement; and wherein said programmable controlling means includes a microprocessor operative for controlling the adjustment of sad extent on the basis of said signals and in dependence on at least one of a predetermined penetration depth and fiber type of the particular bale.

* * * * *